United States Patent [19]

Leuchtag

[11] 4,320,028

[45] Mar. 16, 1982

[54] NUCLEAR WASTE DISPOSAL SYSTEM

[76] Inventor: H. Richard Leuchtag, 215 Market St., Galveston, Tex. 77550

[21] Appl. No.: 39,924

[22] Filed: May 17, 1979

[51] Int. Cl.[2] ..... G21F 9/16

[52] U.S. Cl. ..... 252/628; 29/419 G; 65/2; 405/128; 405/154; 405/184

[58] Field of Search ..... 252/301.1 W, 301.1 R; 65/2; 405/128, 184, 154; 29/403, 419 G

[56] References Cited

U.S. PATENT DOCUMENTS

| | | | |
|---|---|---|---|
| 3,093,593 | 6/1963 | Arrance | 252/301.1 W |
| 3,249,551 | 5/1966 | Bixby | 252/301.1 W |
| 3,321,409 | 5/1967 | Grover et al. | 252/301.1 R |
| 3,364,148 | 1/1968 | Kivel et al. | 252/301.1 R |
| 3,373,116 | 3/1968 | Sun et al. | 252/301.1 L |
| 3,971,717 | 7/1976 | Hild et al. | 252/301.1 W |
| 4,020,004 | 4/1977 | Schulz et al. | 252/301.1 W |

FOREIGN PATENT DOCUMENTS

| | | | |
|---|---|---|---|
| 2433168 | 1/1976 | Fed. Rep. of Germany . | |
| 2722472 | 12/1977 | Fed. Rep. of Germany . | |
| 2755554 | 6/1978 | Fed. Rep. of Germany | 405/128 |

OTHER PUBLICATIONS

Woodrich, D., "Retrievable Surface Storage of High-Level Radioactive Waste", *Chem. Abstracts,* vol. 80: 137035m (Jun. 1974).

Heald, W. "Atlantic Richfield Hanford Company Transuranic Waste Retrieable Burial", *Chem. Abstracts,* vol. 79: 34888s (Aug. 1973).

*Primary Examiner*—Benjamin R. Padgett
*Assistant Examiner*—Deborah L. Kyle

[57] ABSTRACT

In a system and method for disposal of nuclear waste, the waste is mixed with glass components, melted, drawn into fibers and formed into a cable, the diameter of the fibers and the arrangement of the fibers in the cable being such that the cable can be wound onto a support. The cable is then fed through an underground conduit to buffer storage and eventually to a storage space deep beneath the surface of the earth, where it is wound onto a support for extended storage. The cable is equipped with a monitoring system based on optical glass fibers and a leader with which it can be retrieved from the extended-storage space in the event that the integrity of the storage space is threatened or breached. The cable can also be withdrawn for harvesting of specific nuclides in the fiber or for reconstituting with additional nuclear waste material.

28 Claims, 3 Drawing Figures

BUFFER STORAGE AND RETRIEVER
REMOTE CONTROL
MONITOR
HARVESTING
BUFFER STORAGE
CABLE FABRICATOR
COOLING TANK
COUPLING
SOURCE OF OPTICAL MONITOR FIBERS
FIBER FABRICATION
GLASS MELTING
BLEND MELTING
BLENDER
SOURCE OF GLASS COMPONENTS
RADIOACTIVE WASTE SOURCE
WINDER
π : OPTICAL PULSES

NUCLEAR WASTE DISPOSAL SYSTEM

BACKGROUND OF THE INVENTION

The problem of storage of nuclear waste products from both military and civilian sources is presently becoming so acute that further progress, particularly in the field of development of nuclear energy, is threatened. The solutions proposed thus far generally have been based on irretrievable disposal of the wastes. The problems and uncertainties associated with such disposal are clearly summarized in Geological Survey Circular 779, entitled "Geologic Disposal of High-Level Radioactive Wastes . . . Earth-Science Perspectives," by J. B. Bredehoeft et al. Accordingly to these authors, it is estimated that 476,000 spent fuel assemblies will be on hand by the year 2000, occupying 3000 $m^3$, if processed as high-level waste, and an order of magnitude more in intermediate-level waste. The toxicity of these wastes is illustrated by the fact that the quantity of water that would be required to dilute the wastes on hand by year 2000 to levels considered safe is double the quantity of fresh water in global storage. The urgency of the problem is illustrated by the discovery that increasing levels of artificial radionuclides in Lake Erie and Ontario have been traced to Cattaraugus Creek, which flows by an interim waste-storage facility at West Valley, N.Y. (Industrial Research/Development, July 1978, page 46).

The size of the space necessary to accommodate such waste would be only about 10 $km^3$, but the penalty for error in selecting the placement and planning of the facilities to provide it would be most severe. Critical features to be considered are small faults or fracture systems, which are extremely difficult to detect. Although techniques for non-destructive characterization of the site have recently been proposed, these systems require further refinement.

In addition to the problems that arise from the nature of the site prior to storage of the waste products therein, the effect of the mechanical, chemical and thermal disturbance arising from the waste products themselves must be provided for. Canisters of high-level waste may produce 5 kW of heat ten years after reprocessing and it may take as much as one hundred years for the rate to decrease to 0.5 kW. No adequate model of the effects of the hundred-year thermal output exists.

The form of the waste during storage is, of course, of crucial importance. At the present time it appears to be well accepted that high-level wastes from reprocessing may be cast in the form of glass billets, the glass having a very low leachability (Marsily et al, 1977, Energy Research and Development Administration 1976, Page 7). Nevertheless, some contaminants will be released and the nature of the glass itself may change as a result of the radiation so that the rate of leaching will undoubtedly change with time.

Large gaps exist in our knowledge of transport systems, that is, with respect to the course by which released contaminants may reach the biosphere. The problems in this area include lack of knowledge of fractures, natural or manmade, and of measurements of the effect of fluid head and permeability of the rock or salt within which the billets are stored. Data are largely unavailable so that the complete description of groundwater flow is a problem still awaiting solution.

The goal, of course, is to contain the waste and prevent it from reaching the biosphere until it is no longer hazardous. Estimates have been made as to the length of time for which the waste must be stored so that it presents no further damage. Strontium 90 and cesium 137 will constitute 99% of the projected curie accumulation by the year 2020, but these will be reduced to one millionth the initial radioactivity in 600 years. However, the toxicity from iodine 129 and radium and the actinide elements will remain well over ten million years. Ferruccio Gera, 1975, "Geochemical Behavior of Long-Lived Radioactive Wastes: U.S. Energy Research and Development Administration, Oak Ridge National Laboratory, report ORNL TM-4481," at page 14 considered that assuring containment for longer than five million years is "clearly impractical since totally reliable geologic predictions of the detail required over such long time frames are beyond present capability."

The science of geologic prediction is limited by the assumption of constancy of rates of processes and incomplete data; the data in U.S. seismic records go back for only two hundred years. Accordingly, "validating a waste-management model for the time spans of concern will never be possible," according to this author. Even routine predictions of one-hundred-year processes have varied from good to poor. Predictive models, an essential step in selecting a site and managing the waste, have components that are inherently unpredictable at present. Accordingly, these models will not give a single answer to the fate of radioactive waste in geologic repositories but rather a spectrum of alternative outcomes based on uncertain assumptions about the future.

As aforenoted, present thinking is based on the concept of incorporating the nuclear waste in glass and then irretrievably storing the glass, as billets, in a suitable storage space, a substantial thickness of earth providing the shielding. In this concept the sole defense against the access of water, which could solubilize the radioactive material, leading to its transport into the biosphere, is the choice of a stable site. However, as discoveries of the last few years have emphasized, the earth's crust is not stationary. Earthquakes have been noted throughout recorded history, and are much more frequent along certain well-known fault lines, but severe earthquakes in previously "immune" regions are not unknown. More important is the fact that the surface of the earth consists of so-called tectonic plates which move about on the surface of the melt below and clash with each other. The collision between the plates gives rise to mountain ranges and to other types of severe deformation of the crust. Such actions take place both slowly over geologic times and abruptly. Unfortunately, the period over which the nuclear waste must be safeguarded is comparable with the geologic periods over which even the slow but severe changes in the shape of the earth crust may take place. The time of ten million years has already been mentioned above. It has been pointed out that improved reprocessing could reduce the period of concern to about 1000 years; this would reduce but not eliminate the uncertainties. To project the safety of high-level radioactive wastes irretrievably stored over such time periods is therefore impossible. Nevertheless, proposals continue to be put forward that call for storage of such glass billets in hard rock caverns or in salt mines which obviously have been free of ground water for long periods of time. Such proposals originate not only in the United States but in other countries as well. For instance, Frank Feates and Norman Keen of the technology division of Atomic Energy Research Establishment, Harwell, England, publishing in the *New Scientist* of Feb. 16, 1978, propose that liquid waste be converted into glass and encased in steel cylinders 60 cm in diameter and about 3 meters long, each containing about 1.4 tons of glass. They consider that the glass would probably require cooling for several years before final disposal. As the repository for the cylinders, emplacement on or under the ocean bed appears to be a very safe method, according to these authors. They also view favorably the study of disposal in salt formations or clay or hard rock formations, suggesting that the repository be at least 300 m deep so as to lie below the permafrost level in any future ice age. Even so, they do not propose that disposal be carried out at this time, but rather that further data be accumulated. They suggest that small bore holes be drilled so as to investigate fracture structure using television and various physical techniques.

In addition to the problems of storage, there are beginning to be difficulties in the above-ground transport of nuclear wastes. Perceived dangers have led to laws and ordinances restricting passage of vehicles carrying radioactive cargo, for example, in New York, New Jersey and Connecticut (*New York Times*, Apr. 17, 1978).

A number of writers have also raised the concern that fissile isotopes (uranium 235 and plutonium) from nuclear power cycles may, because of their usability in nuclear weapons, become targets for terrorists or blackmailers. This imposes the additional requirement of strict accountability for the wastes during disposal, a condition difficult to satisfy when large numbers of billets must be handled.

Methods of preparing fused glass bodies and suitable compositions have received considerable attention, J. R. Grover et al in U.S. Pat. No. 3,321,409 proposing to mix a radioactive waste liquid with a dry powder in a container, driving off the water and heating the product to fusion to form a glass. Joseph Kivel et al in U.S. Pat. No. 3,364,148 manufacture a source of radioactive energy by enclosing an insoluble radioactive material in a heat-fusible, continuous matrix comprising at least 92% by weight of silica, the peripheral portion of the matrix being free of the radioactive material. H. D. Bixby in U.S. Pat. No. 3,249,551 teaches the disposal of high-level radioactive waste materials by mixing the waste materials in clay and firing the mixture to make a ceramic body; the ceramic body is then covered with a ceramic glaze. F. C. Arrance in U.S. Pat. No. 3,093,593 disposes of radioactive waste by mixing same with ceramic materials, adding water to the mixture, shaping into porous pieces, pre-firing the pieces to destroy the ion-exchange capacity of the ceramic materials, saturating the pieces with radioactive waste materials by absorption, drying and finally firing.

Kuan-Han Sun et al describe the preparation of a radioactive fluophosphate glass composition and making glass fibers of same, in their U.S. Pat. No. 3,373,116. According to the inventors, the glass may be used either in the form of thin glass fibers or small glass particles as a fuel for nuclear reactors. W. W. Schulz et al U.S. Pat. No. 4,020,004 describe the manufacture of a borosilicate glass incorporating radioactive cesium. Werner Hild et al in U.S. Pat. No. 3,971,717 propose to make solid glass blocks containing radioactive wastes and then to place them in water in order to condition the water, said conditioning including sterilization and facilitation of the filterability of the sludge.

As is evident from the above, the incorporation of radioactive waste materials in a glass, particularly of the borosilicate type, has received considerable attention, based, apparently, on the belief that the glass is essentially unattackable by ground water; it is still an open question whether glass is actually impervious to attack by water over period of time extending to millions of years. In fact, accelerated tests at high pressures and temperatures by G. J. McCarthy et al indicate, to the contrary, that such glass is subject, first, to discoloration and fissure formation and, finally, to fracture and crystallization (*Chemical and Engineering News*, June 1, 1978, page 28). In addition, the concept of storage under ground is also looked upon with more or less favor but, as mentioned above, it is beginning to be realized that the integrity of the storage region cannot be predicted with any degree of certainty, so that this solution to the problem of waste disposal must be regarded as flawed. Other modes of disposal, such as firing the waste into solar orbit have also been proposed, but these are not economically feasible at this time. It is evident that either a new approach or an improved approach, eliminating the aforenoted problems, is needed.

SUMMARY OF THE INVENTION

Nuclear waste is incorporated into a glass by any convenient or conventional method, and the molten mixture is drawn into fibers. Preferably, a pool of water is provided for relatively short-term storage of the fibers, during which the intensity of radiation will decrease rapidly, the disposal of the heat generated in the process being more readily effected at this stage of the processing that at a more advanced stage.

The fibers are then made into a bundle or cable, the diameter of the fibers and the number of fibers in the cable being such that the cable is flexible and can be wound on a support. The cable is fed through an underground duct to a well-head and through a well leading deep into the earth to a storage chamber in which winding apparatus winds the flexible cable onto a support for long-term storage. A buffer device for the temporary storage of a portion of the cable is provided between the cable-fabricating plant and the duct to accommodate momentary inequalities between the rates of fabrication and transport through the duct; another such buffer device is installed, for a similar reason, at the well-head. The manufacturing and transport processes are remotely controlled throughout. During both transport and storage, critical information about the state of the cable is received from an in-cable monitoring system.

The cable is so devised that it can be withdrawn from the support to the surface of the earth should the monitoring system indicate that the integrity of the storage chamber is endangered or breached. The cable may also be retrieved for harvesting isotopes or for incorporating additional nuclear waste after the activity of the cable has decreased. As long as no cause for concern or economic motive for retrieval exists, the cable may be left in place indefinitely. Feeding the cable to the waste-receiving facility and then to the storage chamber is facilitated by provision of leaders, that is, non-radioactive segments of the cable, at the forward and rearward ends of the cable. The flexibility of the cable is enhanced by making it in flattened form, that is, in the form of a belt. The cable may be color-coded for identification and may have a coating therearound for retention of glass fragments. Longitudinal variations in the radiation spectra may be used to provide further information for characterizing and identifying locations along the cable.

Transfer of the nuclear waste from the fabrication plant and its buffer device to the well-head is facilitated by provision of an underground conduit through which the cable may be fed with the aid of the leaders. As is evident, a cable is much more readily transported automatically from the melting tank to the well-head than would be glass billets. With the nuclear waste in the form of a cable transportable through a conduit, the problem of transporting nuclear waste above ground is completely eliminated. It is similarly evident that the problem of accounting for a single cable is much less severe than that of keeping track of the thousands of billets it replaces.

The integrity of the cable may be monitored by means of light pulses transmitted through optical fibers associated with the cable.

The underground conduit is positioned far enough below the surface of the earth so that the earth serves to screen out all but a minimal portion of the radiation from the nuclear waste. The optimal depth for the duct is best determined either by measurements on simulated configurations or the adaptation of existing computer codes to a linear source model. The principles of shielding are discussed in L. Wang Lau, *Elements of Nuclear Reactor Engineering,* Gordon & Breach, New York, 1974, where the formal solution for such a model is given. However, rough calculations based on rules of thumb also given by Lau suffice to give an estimate on the depth required. These indicate that a depth equivalent to 2.5 meters of concrete will attenuate the gamma radiation by a factor of $10^8$ and the neutron flux by $10^{25}$. Beta and alpha particles and heavy ions are stopped much more readily than these. The actual depth required will depend on the nature of the soil covering the duct, and an additional safety factor to account for such eventualities as soil erosion and digging by animals and human intruders will be necessary, but a depth of 4 to 5 meters can be entirely satisfactory.

Accordingly, an object of the present invention is a method of forming nuclear waste into glass fibers and then into a flexible cable, which can be stored retrievably in an underground repository.

Another object of the present invention is a method of increasing the utilization of an underground repository for the storage of nuclear waste products by periodically retrieving said waste products after partial decrease in activity thereof and addition of further nuclear waste products.

A further important object of the present invention is a cable of glass fibers containing nuclear waste products, the cable being sufficiently flexible to be wound on a support in a repository deep beneath the surface of the earth and being provided with means for retrieving said cable should such retrieval become desirable or necessary.

A significant object of the present invention is a plant for incorporating nuclear waste products in glass fibers, forming said fibers into a flexible cable, transporting said cable underground to a well-head, dropping said cable into a repository deep below the surface of the earth, winding said cable onto a support, and retrieving said cable from said repository should such retrieval become desirable or necessary.

Yet another important object of the present invention is a plant as described further having a pool of water equipped with fiber-handling devices, and having a buffer storage region in which said fibers can be stored immediately after being drawn, to wait out the initial period during which heat evolution is at a maximum and for removal of the heat generated during this period, prior to their assembly into said cable.

A further significant object of the present invention is a unique monitoring system that continually tests the integrity and state of the cable by the passage and modulation of light pulses transmitted along optical fibers contained in the cables alongside the radioactive fibers.

Still other objects and advantages of the invention will in part be obvious and will in part be apparent from the specification.

The invention accordingly comprises the several steps and the relation of one or more of such steps with respect to each of the others, the apparatus embodying features of construction, combinations and arrangements of parts which are adapted to effect such steps, and the article which possesses the characteristics, properties and relations of elements, all as exemplified in the detailed disclosure hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figures 1, 2, 3:
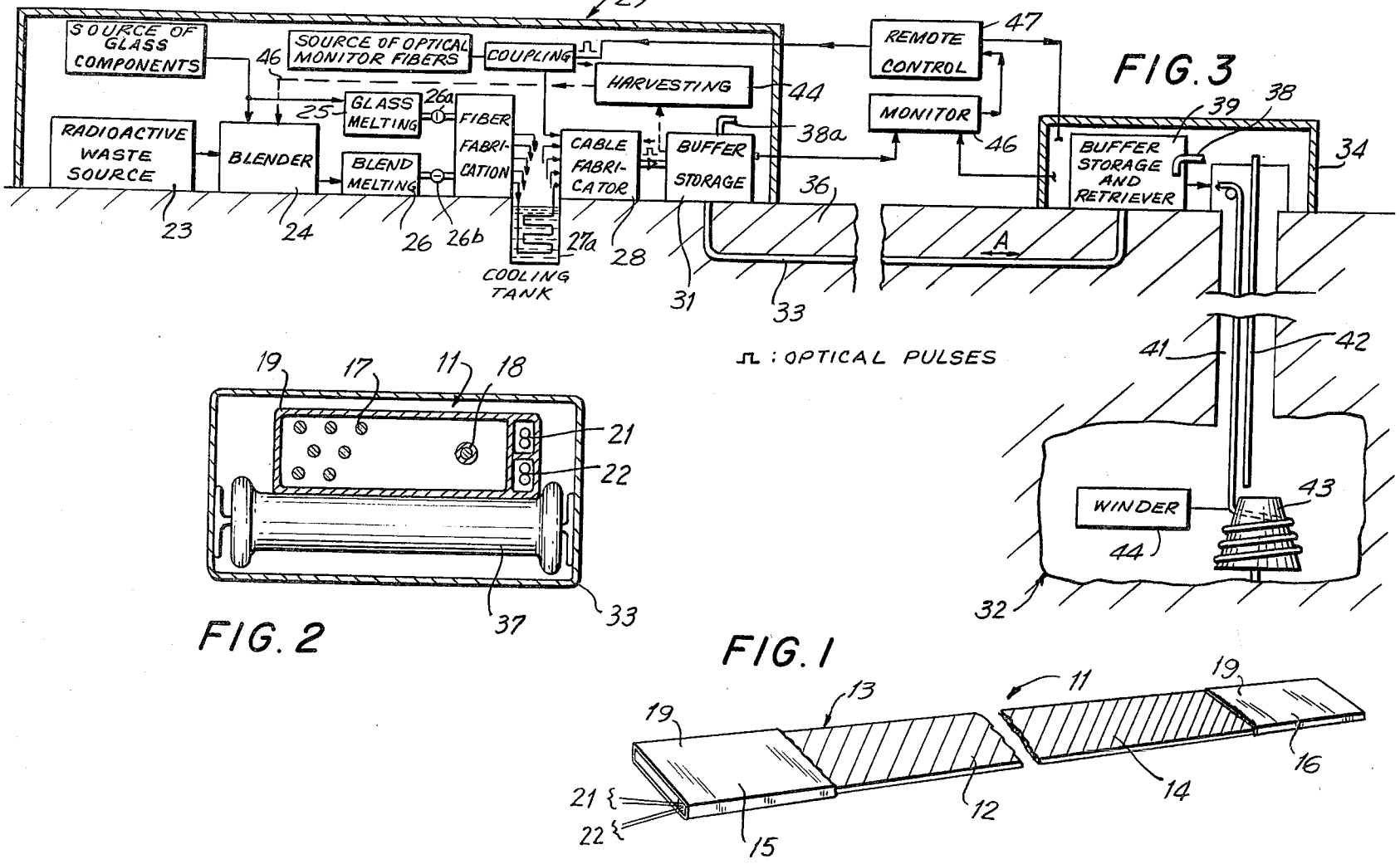
FIG. 1 is a perspective view of a cable in accordance with the present invention.
FIG. 2 is a sectional view of the cable of FIG. 1 in a conduit in accordance with the present invention.
FIG. 3 is a schematic view of a plant for manufacture, transport and storage of a cable in accordance with the present invention.

A cable in accordance with the present invention is shown in FIG. 1 and is indicated generally by the reference numeral 11, said cable being composed of fibers of a vitreous material such as borosilicate glass, the composition of said vitreous material including radioactive waste. The fibers are sufficiently thin and the number of fibers in said cable is such that said cable can be wound on a support. The diameter of the fibers may vary widely, depending upon the number in said cable and the curvature of the support on which said cable is to be mounted. However, the average diameter of said fibers may approximate 100 to 200 micrometers.

Cable 11 has a central radioactive section 12 that may be up to several kilometers long. The rearward end 13 and the forward end 14 of central section 12 merge into non-radioactive leaders 15 and 16 at the boundaries indicated, the fibers in said cable extending from one end of the cable to the other.

Fibers 17, as shown in FIG. 2, may be braided, woven or otherwise bundled together to form said cable 11. The leader sections of the fibers are formed by drawing first a length of ordinary glass, then without break in continuity the long section consisting of a mix of glass and radioactive waste, and finally once more a length containing glass alone. When these fibers are cabled together, the resulting cable is thus provided with non-radioactive leaders at both ends. Cable 11 may be color-coded by incorporation of suitable pigments in the composition or by coating one or more of the fibers with a vitreous layer 18 incorporating such a pigment.

Cable 11 may be of any convenient shape in cross-section but a generally flat configuration, so that the cable is belt-like, is preferred both for improvement of heat-transfer characteristics thereof and for flexibility needed for winding said cable on a support. The belt-like configuration is shown in FIG. 2. While the cable 11 need have no covering thereover, an envelope 19 of a flexible material such as polytetrafluoroethylene may be provided, preferably in mesh net form for ventilation, said envelope serving to retain fragments of fiber that may be produced during the processing and transport of the cable.

In view of the great hazards involved in the manufacture, transport and storage of the cable, it is extremely important that means be provided for monitoring the condition of the cable, the continuity, freedom from cracks and temperature of the cable being particularly important features. In addition, in view of the well-recognized danger of theft of radioactive materials by terrorists, for instance, it is essential that the actual presence and location of the cable be monitored. Such monitoring means are exemplified by fiber optics 21, which are arranged to form a complete loop so that a light pulse can be sent into the loop for monitoring the return thereof. By suitable arrangement, such monitoring means can be adapted to provide indication of the location of a break in the cable should such a break occur. The presence of multiple microscopic cracks in the monitor fiber, symptomatic of a similar condition in the waste-carrying fibers, would be signaled by increased optical attenuation. Also, it is essential that the temperature of the cable not exceed specified limits. For this purpose, temperature-monitoring means such as a cell of thermosensitive dye or liquid crystal 22 may be provided as an adjunct to the cable 11. Such a cell would modulate the light pulses traversing the optical-fiber circuit with information on the temperature at the cell's location. Conveniently, both the temperature-monitoring and integrity-monitoring means 22 and 21 may be incorporated in the envelope 19 so that they constitute part of the cable 11; placement of said monitoring fibers at the extremities of the cable cross-section minimizes radiation exposure.

A plant for the manufacture, transport and storage of the cable in accordance with the present invention is shown in FIG. 3. In general, such a plant will be located proximate a source of radioactive waste material, such as an operating nuclear power reactor, a reprocessing plant or an interim radioactive-waste storage in the manufacture site. The plant of the present invention, shown in schematic form in FIG. 3, as aforenoted, has associated therewith a source 23 of radioactive waste products from which the waste materials are taken to a blender 24 to be mixed with components for preparing a vitreous composition. Needless to say, all operations with radioactive substances carried out in the plant of the present invention are carried out by machine under remote control, so that exposure of personnel to radiation is avoided completely. However, because the initial connections are to the nonradioactive leader, these may be made manually and unnecessary complexity avoided.

From the blender, the fiber constituents are transferred to melting tank 26 and the melt is then drawn into fibers in the fiber-fabrication stage indicated by the reference numeral 27. The fibers may be produced by extrusion or by drawing or by a combination thereof. A large number of fibers are drawn simultaneously. At first, valve **26*a* in FIG. 3 will be open, and fibers of ordinary glass will be drawn to the length desired for the initial leader section. Valve 26*b* is then opened and valve 26*a* is closed, causing the fiber output to become radioactive while the fiber remains continuous. When the radioactive section of each fiber has attained the desired length, valve 26*a* is again opened and 26*b* closed, and the final leader is drawn. The fibers are slowly passed through a water bath to provide for decay of most of the short-term radioactivity. The individual fibers are then bundled into a cable at cable fabricator stage 28**.

It may not always be possible to match the speed of duct transport to the output rate of the fabricator. Short-term buffer storage is therefore provided within the fabrication portion of the plant, said fabrication portion being indicated generally by the reference numeral 29. The short-term buffer storage is indicated by the reference numeral 31.

The cable of the present invention is intended for long-term storage, particularly for underground storage. A suitable location for such underground storage may not be immediately adjacent the source of nuclear waste, thereby introducing the problem of transporting the cable between fabrication plant 29 and the underground storage facility indicated generally by the reference numeral 32. Transport of radioactive products, and particularly waste products, is beset with serious problems arising from the fact that the radioactivity produced and emanating from such products is extremely dangerous to the biosphere and, particularly, to humans. Recently a number of governmental entities have passed laws prohibiting or restricting the transport of such products through the corresponding geographical areas. The form of the cable of the present invention provides a particularly advantageous means of coping with this problem. A shielded conduit 33 is provided between the fabrication plant 29 and a wellhead 34 located over storage region 32. The retrievability of the waste in this system makes the geologic stability of the formation far less critical than for disposal by billets, which are irretrievable. For this reason it can be expected that a suitable site will be found within a few tens of kilometers of practically every source of radioactive waste. The prefered shielding is earth 36, conduit 33 being disposed deeply enough within the earth so that the amount of radiation penetrating the shielding is considered safe on the basis of traffic and land use thereabove, about 4–5 m, as indicated above, being sufficient. It is envisioned that conduit 33 will be located in general within government installations, on former railroad rights of way or within other regions wherein traffic above the conduit can be controlled so as to further ensure that exposure to the radiation is held within safe limits. Conduit 33, as shown in FIG. 2, is fitted with devices such as roller 37 to support cable 11 for low-friction transport of said cable through conduit 33. The cable is sufficiently flexible so that it can be transported around bends as shown in FIG. 3. Also, since the cable 11 will in general be evolving substantial quantities of heat, cooling air may be circulated through said conduit, a source of cooling air or other coolant being indicated as entering conduit 33 through pipe 38 and exiting through pipe **38*a*. In the arrangement shown in FIG. 3, the coolant introduced through pipe 38 also serves to cool cable 33 during buffer storage at stages 39 and 31. The storage chambers are designed to make maximal use of air convection currents driven by the temperature gradients present to transfer heat to the chamber walls. Cable 11 is lowered through vertical well 41 into storage chamber 32, where support devices 43, preferably in the form of conical reels, and automatic winder means 44 are provided for emplacing the cable 11 and the front cable leader 14 on the support 43**. A single conduit and waste-receiving facility could serve a cluster of several repositories.

As aforenoted, the length of the period for which the cable must be stored is so great that the integrity of chamber 32 may be threatened or even breached by unforeseen thermal, geological or hydrologic processes despite the initial apparent safety thereof. Accordingly, therefore, means for retrieval of cable 11 from storage chamber 32 must be provided; buffer storage stage 39 is provided for this purpose; rear cable leader 15 is secured at the well-head and constructed so that it can retrieve the contents of chamber 32. The well-head chamber and conduit provide sufficient space so that, should retrieval for purposes of safety become necessary, they can together accommodate the entire contents of chamber 32 for a period of time sufficient so that another storage place can be developed.

Retrieval may be necessary or desirable for other purposes, such as harvesting of isotopes present in the nuclear waste. Such harvested radioisotopes can be useful in energy generation, medical treatment and diagnosis, and for other possible applications. An example of a large-scale application being investigated is the treatment of sewage by exposure to gamma rays from cesium 137. Means for such harvesting are indicated by stage 44 within the fabrication plant 29. For this purpose, it is necessary that conduit 33 be constructed for two-way transfer of the cable. The paths in the retrieval phase are indicated by dashed lines. After harvesting of the desired isotope, the remaining components may be recycled to the blender 24, for fabrication again into fiber cable. Another reason for retrieving the cable may be to take advantage of the fact that the radioactivity thereof has decreased to a level such that it is no longer economical to devote storage space to same. Under such circumstances, the cable can be recycled to blender 24 where it is recombined with additional radioactive waste from source 23 and then sent through the fabrication process once more. Alternatively, the inert content of the fiber can be decreased, preferably using harvesting stage 44 for this purpose.

A major advantage of the cable, the process for fabricating same and the storage chamber comprising the plant is that it can be monitored closely, as indicated by monitoring station 46, to make certain of the integrity of the cable, the temperature thereof, and the temperature of the storage space 32. This station or console is the terminal for all monitor-fiber pairs included in a cable. There, light pulses from light-emitting diodes or lasers are transmitted into the cable and, if the integrity of the cable has not been breached, received back from the cable. The temperature-sensing fibers pass into and out of detector cells consisting of optically thermoactive materials, either dyes or liquid crystals, which modulate the light according to the temperature at their location. Cracking or the development of other imperfections in the glass, symptomatic of possible cable damage, can be observed from the resulting light attenuation. Furthermore, on the basis of information supplied by monitor 46 to remote control means 47, the operation of the fabrication plant 29, supply of coolant to said plant to well-head 34 and storage space 32 can be adjusted and decision as to possible retrieval of cable can be made on a fail-safe basis.

As is evident from the above, the process, plant and cable of the present invention make it possible to incorporate radioactive waste in a form such that the waste is transportable without hazard either to the environment or the inhabitants thereof, and to store the waste under conditions such that anticipated and unanticipated changes can be coped with. The techniques for incorporating the waste into glass are wellknown and the knowledge and skills involved in their processing into fibers and cables are well understood. The process is adaptable so that valuable isotopes can be retrieved from the cable and, if desired, the heat evolved by the waste products during storage can be utilized.

It will thus be seen that the objects set forth above, among those made apparent from the preceding description, are efficiently attained and, since certain changes may be made in carrying out the above process, in the described product, and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

What is claimed is:

1. In the method of long-term storage of radioactive waste products wherein said waste products are first made into a vitreous composition containing a suitable content of inert components as diluents and melted, the improvement comprising the steps of:

forming said melted composition into fibers;

forming said fibers into a cable of selected length and having forward and rearward ends, the diameter of said fibers and the number of fibers being such that said cable is sufficiently flexible to be wound onto support means;

providing leader means at said forward end of said cable for feeding said cable to said support means and at said rearward end for retrieving said cable from said support means; and lowering said cable to a region having sufficient shielding to protect the biosphere, winding said cable onto said support means in said region and storing said cable on said support means, said method providing for retrieving said cable should said region become unsafe for storage of said cable and for further processing.

2. The improvement as defined in claim 1, further comprising the steps of storing said fibers in a pool of water prior to fabrication into a cable, said storage in said pool being continued for a period long enough for the rate of heat evolution to subside to a selected value and to provide for inspection to ensure that said fibers are capable of performing satisfactorily.

3. The improvement as defined in claim 1, further comprising the step of temporarily storing said cable in a buffer storage area subsequent to fabrication of same and prior to lowering said cable to said region, said temporary storage serving for smoothing differences between the rates of fabrication of said cable and lowering same to said region.

4. The improvement as defined in claims 1, 2 or 3, further comprising the steps of retrieving said cable from said region after a period such that the quantity of a nuclide originally constituting a major source of the radiation from said cable has decreased substantially, remelting the fibers, readjusting the composition, and repeating the steps of claim 1.

5. The improvement as defined in claim 4, wherein said readjustment comprises harvesting of useful isotopes produced during storage.

6. The improvement as defined in claim 4, wherein said readjustment comprises at least partial removal of said inert components to increase the concentration of radioactive materials in said vitreous composition.

7. The improvement as defined in claim 4, wherein said readjustment comprises addition of further radioactive waste products to increase the concentration of radioactive material in said vitreous composition.

8. The improvement as defined in claim 1, further comprising the step of monitoring the integrity of said cable.

9. The improvement as defined in any of claim 1 or 8, further comprising the step of providing optical fibers in said cable arranged and constructed for transmitting optical signals both forwardly and rearwardly along said cable, thereby providing for monitoring of said cable by optical means.

10. The improvement as defined in claim 1, further comprising the step of monitoring the temperature of said cable.

11. The improvement as defined in claim 1, wherein said support means is constructed for cooling of same and said cable during storage thereon.

12. A cable of a vitreous composition containing radioactive waste products, said cable comprising fibers of diameter, number and arrangement such that said cable is sufficiently flexible to be wound on support means, said cable having a forward end and a rearward end, said forward end being provided with leader means for winding said cable onto said support means and said rearward end being provided with leader means for retrieving said cable from said support means.

13. The cable as defined in claim 12, wherein said forward and rearward end means are flexible leaders of fibers of non-radioactive vitreous composition.

14. The cable as defined in claim 12, wherein said cable further comprises means for monitoring the integrity thereof, including monitoring the continuity of said cable and the presence thereof.

15. The cable as defined in claim 14, wherein said monitoring means is optical.

16. The cable as defined in claim 14, wherein said monitoring means comprises fiber optics.

17. The cable as defined in claim 12, wherein said cable is in the form of a flat belt to improve heat removal therefrom and flexibility thereof.

18. The cable as defined in claim 12, wherein said cable further comprises means for monitoring the temperature thereof.

19. The cable as defined in claim 12, wherein said cable is color-coded for identification.

20. The cable as defined in claim 12, wherein said cable further contains radioactive markers for identification.

21. The cable as defined in claim 12, wherein said cable further comprises a coating for retaining fiber fragments which may be produced in manufacture or transport.

22. The cable as defined in claim 12, wherein the diameter of said fibers is about 100–200 micrometers.

23. A system for retrievable storage of a flexible cable of a vitreous composition containing radioactive waste products and for long term storage of said cable, comprising:

means for combining said radioactive waste products with inert components into a vitreous composition and melting said composition;

means for forming said molten composition into flexible fibers;

means for forming said fibers into a flexible cable having a forward end and a rearward end;

storage space deep in the earth for long-term storage of said cable;

a well leading from the surface of the earth to said storage space;

a well-head at the surface of the earth and over said well;

means in said storage space for winding said cable onto support means;

means for retrieval of said cable from said storage space; and conduit means shielded against passage of radiation for transport of said cable therethrough from said forming means to said well-head.

24. The system as defined in claim 23, further comprising a buffer region intermediate said cable forming means and said storage space for temporary residence of said cable therein, said buffer region being connected with said storage space and said cable forming means by said shielded conduit.

25. The system as defined in claim 23, further comprising remote and proximate monitoring means for determining the integrity and location of said cable.

26. The system as defined in claim 23, further comprising remote and proximate means for determining the temperature of said cable.

27. The system as defined in claim 23, further comprising means for attaching leaders to said cable at the forward and rearward ends thereof.

28. The system as defined in claim 23, wherein a major portion of said conduit means lies sufficiently far beneath the surface of the earth to be essentially shielded by said earth against a major quantity of radiation reaching said surface from cable in said conduit means, thereby eliminating the possibility of danger caused by above-surface transport of radioactive waste products.

* * * * *